US008968049B2

(12) United States Patent
Hasegawa

(10) Patent No.: US 8,968,049 B2
(45) Date of Patent: Mar. 3, 2015

(54) SPACER FOR AN ADJUSTABLE WIDTH ROTATABLE PERFORMANCE DEVICE

(75) Inventor: Takahiko Hasegawa, Naritahigashi (JP)

(73) Assignee: Flambeau, Inc., Baraboo, WI (US)

( * ) Notice: Subject to any disclaimer, the term of this patent is extended or adjusted under 35 U.S.C. 154(b) by 308 days.

(21) Appl. No.: 13/366,972

(22) Filed: Feb. 6, 2012

(65) Prior Publication Data

US 2012/0252312 A1 Oct. 4, 2012

Related U.S. Application Data

(60) Provisional application No. 61/470,153, filed on Mar. 31, 2011.

(51) Int. Cl.
*A63H 1/30* (2006.01)

(52) U.S. Cl.
CPC ..... *A63H 1/30* (2013.01)
USPC ..... 446/250

(58) Field of Classification Search
CPC ..... A63H 1/30; A63H 1/32; A63H 1/06
USPC ..... 446/247–254, 255
See application file for complete search history.

(56) References Cited

U.S. PATENT DOCUMENTS

| | | | | |
|---|---|---|---|---|
| 116,773 | A | | 7/1871 | Sumner |
| 903,419 | A | | 11/1908 | Skeer |
| 1,554,781 | A | | 9/1925 | Blecker |
| 1,793,151 | A | | 2/1931 | Asbury et al. |
| 2,030,302 | A | | 2/1936 | Jones |
| 2,676,432 | A | | 4/1954 | Field |
| 2,680,933 | A | | 6/1954 | Laurens et al. |
| 2,744,354 | A | | 5/1956 | Watkins et al. |
| 3,076,287 | A | | 2/1963 | Jermyn |
| 3,175,326 | A | * | 3/1965 | Isaacson ..... 446/250 |
| 3,314,409 | A | | 4/1967 | Olson |
| 3,341,969 | A | | 9/1967 | Olson |
| 3,624,958 | A | * | 12/1971 | Salayka ..... 446/216 |
| 3,653,148 | A | | 4/1972 | Finkel |
| 3,728,813 | A | | 4/1973 | Jolliffe |
| 3,883,985 | A | | 5/1975 | Dawson, Jr. |
| 4,130,962 | A | | 12/1978 | Ennis |
| 4,212,131 | A | * | 7/1980 | Ross, Jr. ..... 446/48 |
| 4,327,518 | A | | 5/1982 | Knauff |
| 4,452,007 | A | | 6/1984 | Martin |
| 5,017,172 | A | * | 5/1991 | Seifert ..... 446/250 |
| 5,100,361 | A | * | 3/1992 | Kuhn et al. ..... 446/250 |
| 5,389,029 | A | | 2/1995 | McAvoy, Jr. |
| 5,951,361 | A | | 9/1999 | Van Dan Elzen et al. |
| 5,984,759 | A | | 11/1999 | O'Sullivan |
| 6,066,024 | A | | 5/2000 | McAvoy, Jr. |
| 6,080,035 | A | * | 6/2000 | Pekarsky et al. ..... 446/250 |
| 6,113,456 | A | | 9/2000 | Hadzicki et al. |

(Continued)

FOREIGN PATENT DOCUMENTS

| | | | |
|---|---|---|---|
| GB | 2132100 | A | 7/1984 |
| GB | 2200853 | A | 8/1988 |

*Primary Examiner* — Gene Kim
*Assistant Examiner* — Alyssa Hylinski
(74) *Attorney, Agent, or Firm* — Quarles & Brady LLP

(57) ABSTRACT

A rotatable performance device, such as a yo-yo, is modifiable such that the device can act as both a relatively narrow looping yo-yo and a relatively wide string trick yo-yo. Inner lobe spacers that facilitate these modifications and a method for attaching the spacers to the rotatable performance device to change its play characteristics are also disclosed.

23 Claims, 4 Drawing Sheets

(56) References Cited

U.S. PATENT DOCUMENTS

| | | | | |
|---|---|---|---|---|
| 6,142,850 | A * | 11/2000 | Levy | 446/250 |
| 6,162,109 | A * | 12/2000 | Baier | 446/250 |
| 6,196,890 | B1 | 3/2001 | Amaral | |
| 6,196,891 | B1 | 3/2001 | Jamison | |
| 6,213,838 | B1 | 4/2001 | Amaral | |
| 6,220,920 | B1 | 4/2001 | Baier | |
| 6,234,861 | B1 | 5/2001 | Ichii et al. | |
| 6,331,132 | B1 * | 12/2001 | Watson | 446/250 |
| 6,533,636 | B2 | 3/2003 | Holenstein et al. | |
| 6,565,408 | B1 | 5/2003 | Marcantonio et al. | |
| 6,579,142 | B1 * | 6/2003 | Rehkemper et al. | 446/247 |
| 6,599,165 | B1 | 7/2003 | Van Dan Elzen | |
| 6,887,122 | B1 | 5/2005 | Van Dan Elzen et al. | |
| 6,896,576 | B1 * | 5/2005 | VanKuiken | 446/247 |
| 7,125,310 | B1 | 10/2006 | Van Dan Elzen | |
| 7,149,281 | B2 | 12/2006 | Lacherade et al. | |
| 7,175,500 | B1 | 2/2007 | Difeo | |
| 7,192,330 | B2 | 3/2007 | Van Dan Elzen | |
| 7,621,796 | B2 | 11/2009 | Schonert et al. | |
| 7,874,890 | B2 | 1/2011 | Van Dan Elzen | |
| 8,414,348 | B2 * | 4/2013 | Weems | 446/255 |
| 2004/0198151 | A1 | 10/2004 | Bell | |
| 2005/0287910 | A1 | 12/2005 | O'Sullivan | |
| 2006/0094329 | A1 * | 5/2006 | Van Dan Elzen | 446/250 |
| 2006/0178083 | A1 * | 8/2006 | Van Dan Elzen | 446/250 |
| 2007/0105478 | A1 | 5/2007 | Van Dan Elzen et al. | |
| 2010/0210174 | A1 | 8/2010 | Weems | |
| 2012/0244780 | A1 * | 9/2012 | Van Dan Elzen et al. | 446/250 |

* cited by examiner

SPACER FOR AN ADJUSTABLE WIDTH ROTATABLE PERFORMANCE DEVICE

CROSS-REFERENCE TO RELATED APPLICATION

This application claims the benefit of U.S. Provisional Patent Application No. 61/470,153 filed Mar. 31, 2011, the disclosure of which is hereby incorporated by reference in its entirety.

STATEMENT CONCERNING FEDERALLY SPONSORED RESEARCH OR DEVELOPMENT

Not applicable.

BACKGROUND OF THE INVENTION

The present invention relates to rotatable performance devices, particularly yo-yos having components that are selectively detachable to vary "play" characteristics of the device.

Rotatable performance devices, such as diabolos, yo-yos, and the like, are well-known entertainment devices for performing maneuvers or tricks. Yo-yos include a string that engages an axle of the device, and the string is initially wound around the axle and connected to a user's finger. The yo-yo is "thrown down" to cause two halves or lobes of the yo-yo to spin relative to the string. After the lobes begin spinning or "sleeping" at the end of the string, the user may perform maneuvers such as "walking the dog", swinging the yo-yo "around the world", and the like.

Depending generally on the distance between the lobes and their size and shape, yo-yos have different types of motion or "play" characteristics. For example, a yo-yo is typically classified as a "string trick" yo-yo if weight is concentrated at the rims of the lobes. Such a configuration provides stability and facilitates tricks involving string manipulation. Conversely, a yo-yo is typically classified as a "looping" yo-yo if the weight of the lobes is concentrated near the center of the yo-yo. This configuration facilitates tricks in which the yo-yo is kept in motion without simply sleeping at the end of the string.

String trick yo-yos cannot typically be modified to act as looping yo-yos and vice versa. As such, many yo-yo users typically purchase and, in the case of yo-yo competitions, carry at least one string trick yo-yo and at least one looping yo-yo to perform the different types of tricks described above. Considering these drawbacks of previous yo-yos, a yo-yo design is needed that permits easy modification of play characteristics.

SUMMARY OF THE INVENTION

The present invention provides a rotatable performance device, such as a yo-yo, with modifiable play characteristics such that the device can act as both a relatively narrow looping yo-yo and a relatively wide string trick yo-yo. The present invention also provides spacers that facilitate these modifications and a method for attaching the spacers to the rotatable performance device to changes its play characteristics.

In one aspect of the invention, an inner lobe spacer comprises a first face including a recess having a first cross-sectional size, and the recess is configured to receive a bearing member. The inner lobe spacer further comprises a second face opposite the first face and including a projection having a second cross-sectional size. The second cross-sectional size is equal to the first cross-sectional size within a clearance fitting range, and the projection is configured to be received in an outer lobe recess of an outer lobe. The inner lobe spacer further comprises an angled surface disposed between the first face and the second face. The angled surface faces a direction that forms an acute angle with a width direction between the first face and the second face. The angled surface is thereby configured to direct a tether connected to the bearing member away from the second face.

In another aspect of the present invention, a rotatable performance device comprises an axle and a bearing member supported by the axle. An inner lobe spacer is detachably supported by the axle and has an inner lobe spacer recess sized to clearance-fittingly receive the bearing member. A first outer lobe is supported by the axle proximate the inner lobe spacer and opposite the bearing member. The first outer lobe has a first outer lobe recess sized to clearance-fittingly receive the bearing member if the inner lobe spacer is detached from the axle. The device further comprises a second outer lobe supported by the axle opposite the first outer lobe.

In yet another aspect of the present invention, a method of modifying a rotatable performance device comprises the steps of A) detaching a first outer lobe and a second outer lobe from a first axle having a first longitudinal length; B) connecting an inner lobe spacer to a second axle having a second longitudinal length, the second longitudinal length being greater than the first longitudinal length; and C) connecting the first outer lobe and the second outer lobe to the second axle such that the inner lobe spacer is disposed between the first outer lobe and the second outer lobe and the first outer lobe is supported by the second axle at a second distance from the second outer lobe, the second distance being greater than the first distance.

In yet another aspect of the present invention, a kit for modifying a rotatable performance device comprises an inner lobe spacer configured to be disposed between a first outer lobe and a second outer lobe of a rotatable performance device. The spacer includes a first face, a second face opposite the first face, an inner passageway connecting the first face and the second face, and an angled surface disposed between the first face and the second face. The angled surface faces a direction that forms an acute angle with a width direction between the first face and the second face. The angled surface is thereby configured to direct a tether connected to the rotatable performance device away from the second face. The kit further comprises an axle configured to extend through the inner passageway and replace another axle of the rotatable performance by engaging the first outer lobe and the second outer lobe.

The foregoing and advantages of the invention will appear in the detailed description which follows. In the description, reference is made to the accompanying drawings which illustrate a preferred embodiment of the invention.

BRIEF DESCRIPTION OF THE DRAWINGS

The invention will hereafter be described with reference to the accompanying drawings, wherein like reference numerals denote like elements, and.

DETAILED DESCRIPTION OF THE INVENTION

Figure 1:
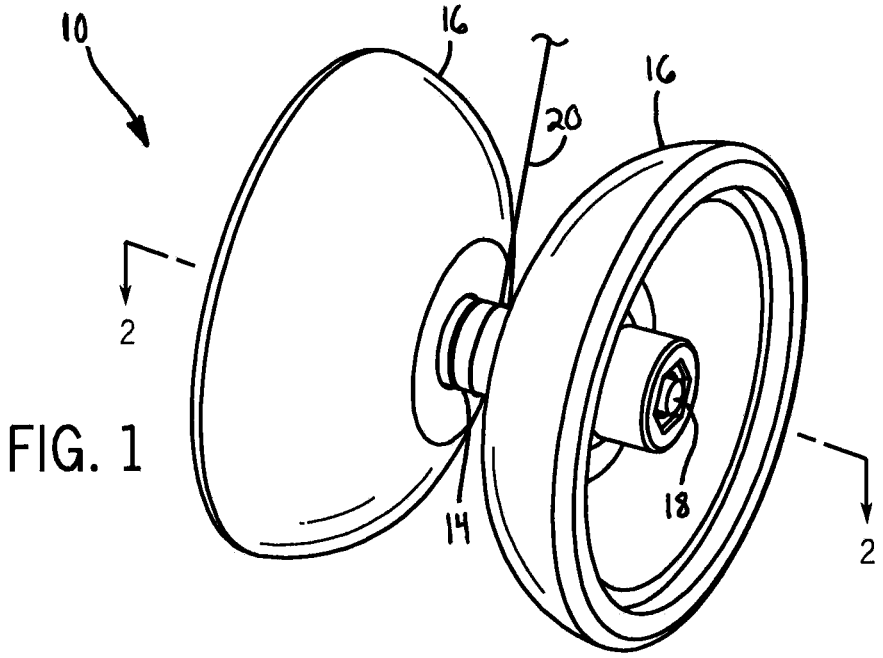
FIG. 1. is a perspective view of a rotatable performance device before inner lobe spacers of the present invention are connected to the device.

The particulars shown herein are by way of example and only for purposes of illustrative discussion of the embodiments of the invention. The particulars shown herein are presented to provide what is believed to be the most useful and readily understood description of the principles and conceptual aspects of the invention. In this regard, no attempt is made to show structural details of the invention in more detail than is necessary for the fundamental understanding of the invention. The description taken with the drawings should make apparent to those skilled in the art how the several forms of the present invention may be embodied in practice.

Referring generally to FIGS. 1-5, the invention provides both a rotatable performance device, such as a yo-yo 10, with modifiable play characteristics and inner lobe spacers 12 (FIGS. 3-5) that facilitate such modifications. In particular, the inner lobe spacers 12 are attachable and detachable from between a bearing assembly 14 and rotatable outer lobes 16 to vary the width of the yo-yo 10. As such, the yo-yo 10 can act as both a relatively narrow looping yo-yo and a relatively wide string trick yo-yo. These aspects, in addition to details of the above components, are further described below.

Still referring to FIGS. 1-5, the yo-yo 10 includes an axle 18 that supports the above components and provides an axis about which some components of the yo-yo 10 rotate relative to a support string or tether 20. In the embodiments shown in the figures, the axle 18 includes a nut 22 and two threaded bolts 24*a* and 24*b* having different lengths. When the inner lobe spacers 12 are detached from the device (FIG. 2), the shorter bolt 24*a* connects to the nut 22. Conversely, when the inner lobe spacers 12 are connected to the device (FIG. 4), the longer bolt 24*b* connects to the nut 22.

Figure 2:
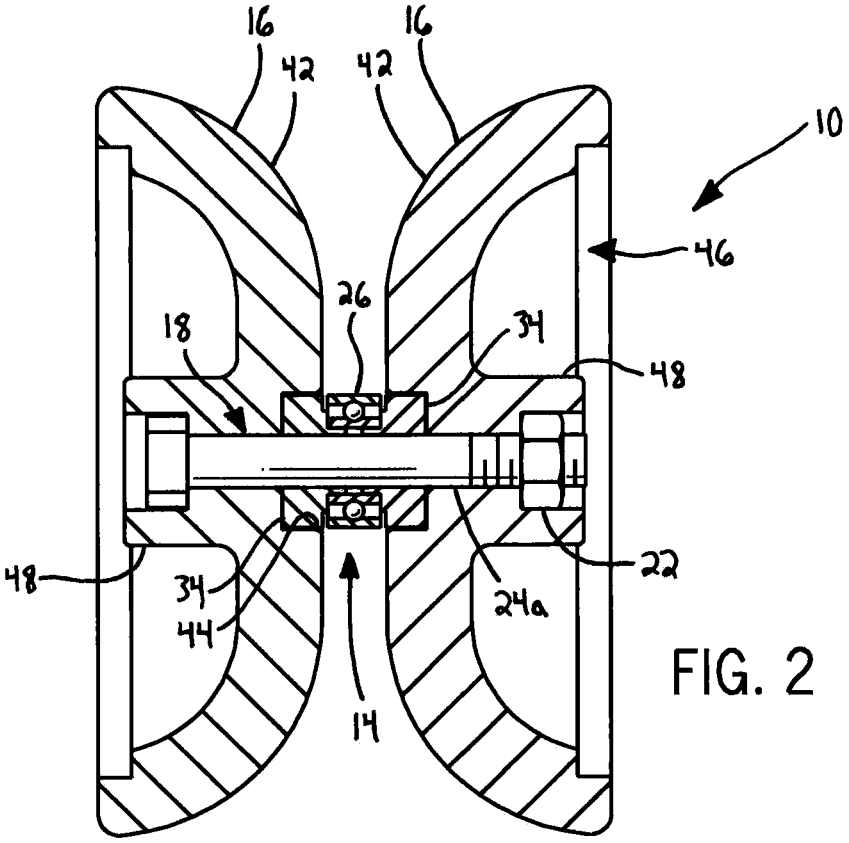
FIG. 2 is a section view of the rotatable performance device along line 2-2 of FIG. 1.
Figures 4, 6, 7, 8:
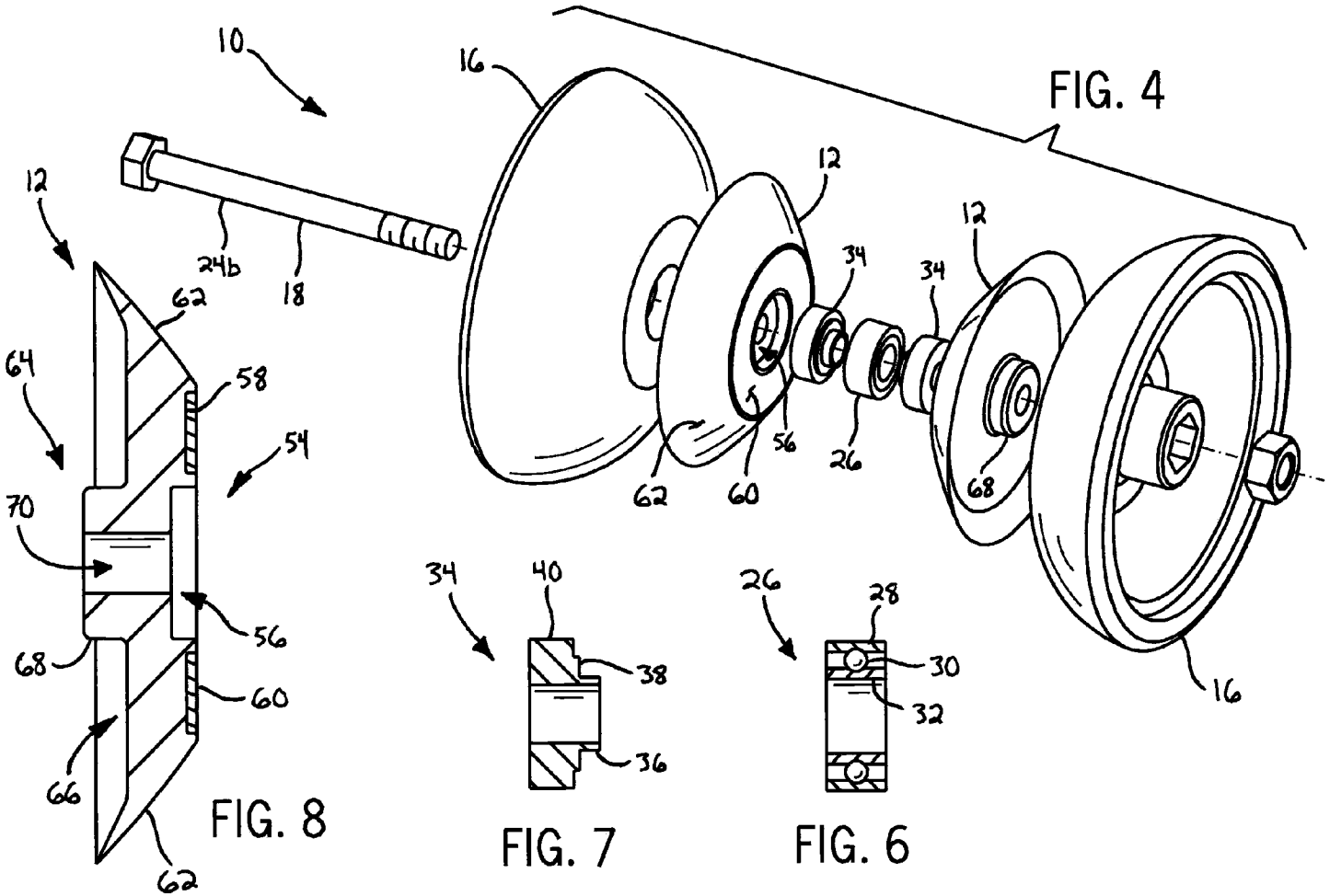
FIG. 4 is an exploded perspective view of the rotatable performance device of FIG. 3.
FIG. 6 is a section view of a tether bearing of the rotatable performance device along line 5-5 of FIG. 3.
FIG. 7 is a section view of a bearing spacer of the rotatable performance device along line 5-5 of FIG. 3.
FIG. 8 is a section view of the inner lobe spacer of the rotatable performance device along line 5-5 of FIG. 3.

Turning now to FIGS. 2, 4, and 6, the axle 18 supports the bearing assembly or member 14 along the shaft of the bolt 24*a*, 24*b*. In general, the bearing member 14 permits relative rotation between some components of the yo-yo 10 and the tether 20. To this end, the bearing member 14 includes a support bearing 26 which may be any appropriate type of bearing, such as a ball bearing. Such a bearing 26 includes a generally annular outer race 28 (FIG. 6) that connects to the tether 20. Rolling elements 30, such as ball elements, separate the outer race 28 from a generally annular inner race 32. As a result, during use the outer race 28 remains stationary relative to the tether 20 while the inner race 32 rotates, together with the remaining components of the yo-yo 10, relative to the tether 20.

Referring to FIGS. 2, 4, and 7, the bearing member 14 further includes bearing spacers 34 supported by the axle 18 on opposite axial sides of the bearing 26. The two bearing spacers 34 are generally identical, and the yo-yo 10 is generally symmetrical over a vertical plane bisecting the support bearing 26. As such, only one axial side of the yo-yo 10 will be described in the remainder of the description for simplicity.

The bearing spacer 34 may be a component formed using well-known materials and methods (e.g., molded metals, thermoplastics, or the like). The bearing spacer 34 is also generally cylinder-shaped, symmetrical about the axle 18, and mounts the support bearing 26 at an appropriate location apart from the inner lobe spacer 12 and the outer lobe 16. To this end, the bearing spacer 34 includes a relatively small diameter annular projection 36 (FIG. 7) disposed within the support bearing 26 and engaging the inner race 32. Adjacent the annular projection 36, the bearing spacer 34 includes a larger diameter shoulder surface 38 that engages the side of the support bearing inner race 32. As such, the two bearing spacers 34 sandwich and axially restrain the bearing 26 therebetween. Adjacent the shoulder surface 38, the bearing spacer 34 includes a relatively large annular portion 40. The annular portion 40 has a diameter that is similar to diameters of recesses of the inner lobe spacer 12 and the outer lobe 16 that may receive the bearing spacer 34 as described in further detail below.

Figure 9:
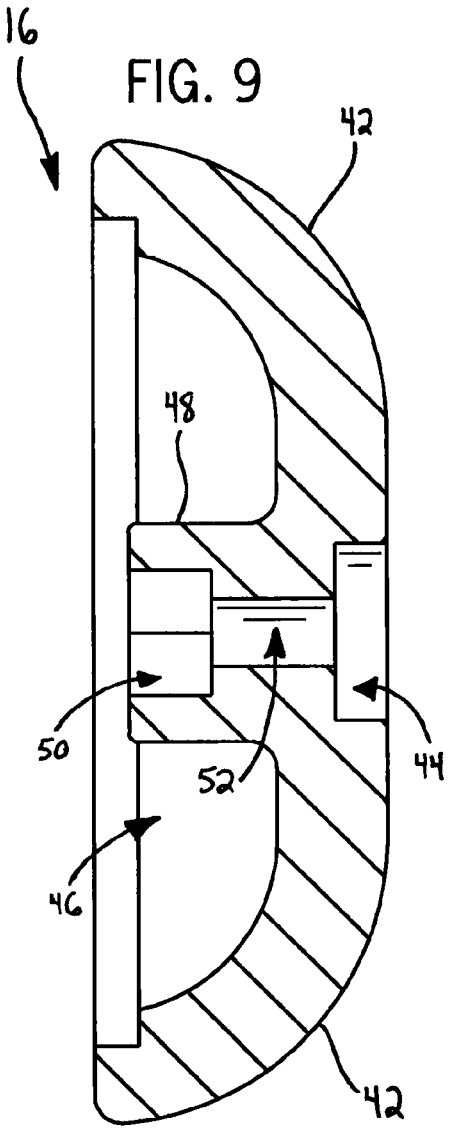
FIG. 9 is a section view of an outer lobe of the rotatable performance device along line 5-5 of FIG. 3.

Referring now to FIGS. 2, 4, and 9, the axle 18 and, in some situations, the bearing spacer 34, engages the outer lobe 16. The outer lobe 16 may be a component formed using well-known materials and methods (e.g., machined aluminum, a molded thermoplastic, or the like). In any case, the outer lobe 16 is preferably symmetrical about the axle 18. In addition, the outer lobe 16 includes a wall having a curved surface 42 that provides the outer lobe 16 with a general bowl shape. The curved surface 42 ensures the tether 20 remains disposed between the outer lobes 16 in use and inhibits the tether from engaging and winding around the outer lobe 16.

Adjacent the curved surface 42, the outer lobe 16 includes an outer lobe recess 44 (FIG. 9) that is configured to receive the bearing spacer 34 when the inner lobe spacer 12 is removed from the device 10. The outer lobe recess 44 has a cylindrical shape with a diameter sized to clearance-fittingly receive the bearing spacer 34. As used herein, the term "clearance fit" and variations thereof means that a first component can be axially inserted into and removed from a recess of a second component, but the first component cannot generally be moved in a transverse direction perpendicular to the axial direction when disposed in the recess. Stated another way, the outer lobe recess 44 and bearing spacer 34 cross-sectional sizes (i.e., diameters) are equal to each other within a clearance fitting range. The phrase "equal within a clearance fitting range" and variations thereof means that dimensions of two components are sufficiently similar to permit one of the components to be clearance-fittingly received in the other component. In the present case, the clearance fit connection between the bearing spacer 34 and the outer lobe 16 firmly connects the two components and inhibits the outer lobe 16 from wobbling as it rotates relative to the tether 20.

Opposite the curved surface 42 and the outer lobe recess 44, the wall of the outer lobe 16 defines a rear recess 46 that faces away from the tether 20. A generally cylindrical projection 48 extends into the rear recess 46 and receives the head of the bolt 24*a*, 24*b* in a bolt recess 50 (e.g., a hexagonal-shaped recess). The other outer lobe 16 receives the nut 22 in a nut recess 50 (e.g., a hexagonal-shaped recess). An axle passageway 52 connects the bolt recess 50 and the outer lobe recess 44. As the name implies, the axle passageway 52 is sized to receive the shaft of the bolt 24*a*, 24*b*.

Figure 3:
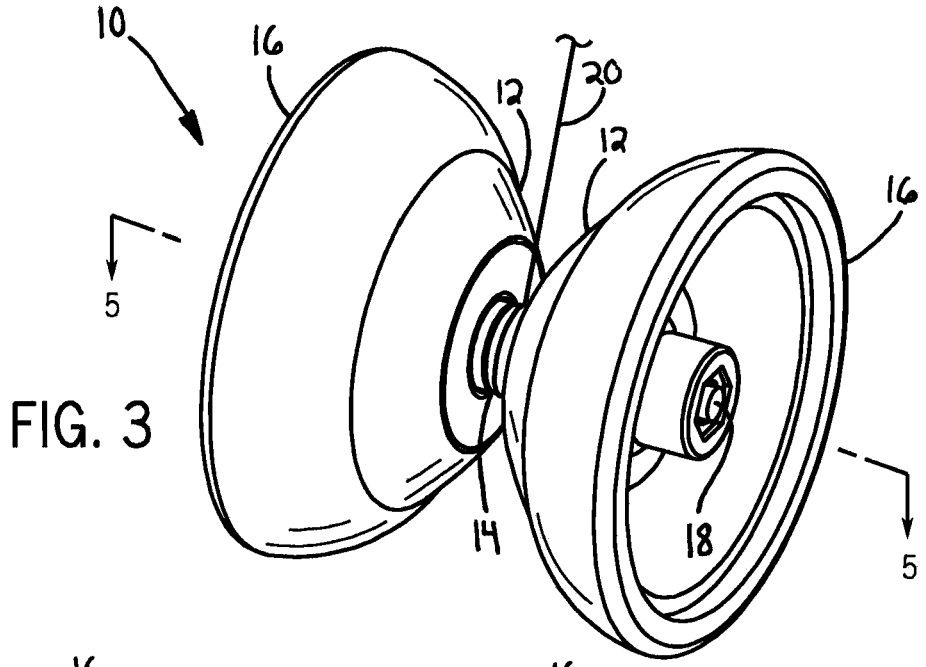
FIG. 3 is a perspective view of the rotatable performance device including inner lobe spacers of the present invention connected to the device.
Figure 5:
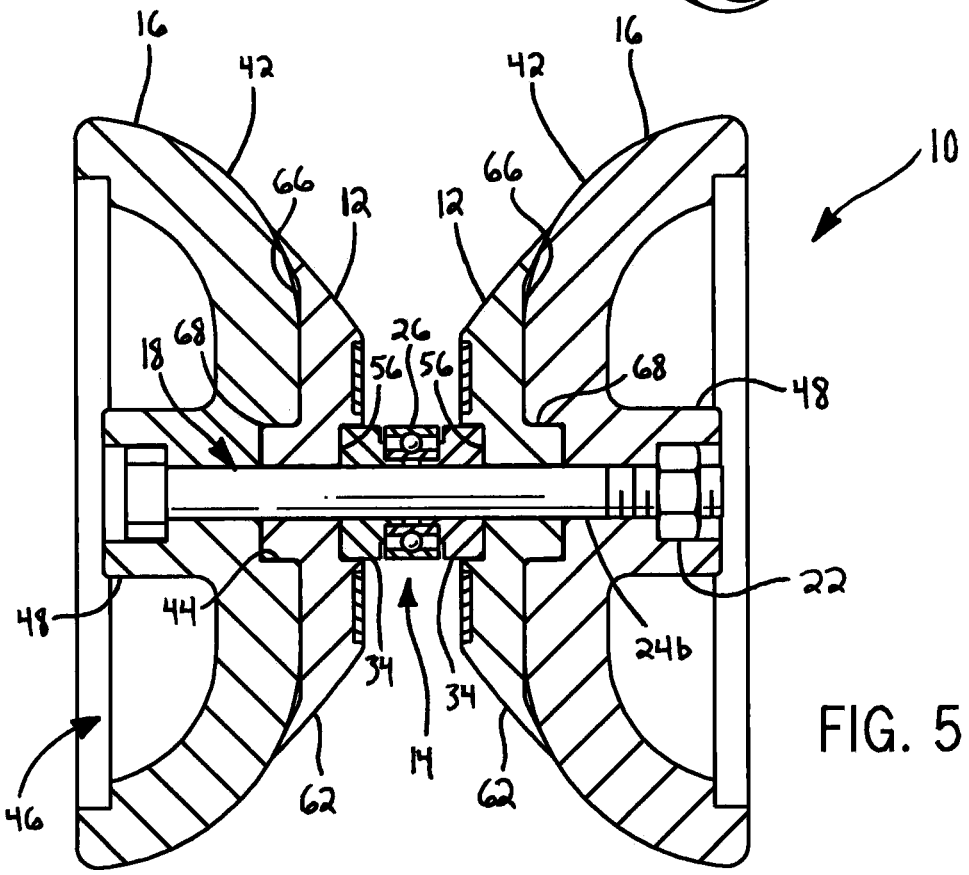
FIG. 5 is a section view of the rotatable performance device along line 5-5 of FIG. 3.

Turning now to FIGS. 3-5 and particularly FIG. 8, inner lobe spacer 12 may be a component formed using well-known materials and methods (e.g., machined aluminum, a molded thermoplastic, or the like). As briefly described above, the inner lobe spacer 12 may be added to and removed from the yo-yo 10 to vary the width of the yo-yo 10 and thereby alter its play characteristics. Moreover, the inner lobe spacer 12 includes a wall having a general axisymmetrical flying disk shape that, together with the spacer's 12 other features and sizes described below, permit the spacer 12 to act as an extension of the outer lobe 16.

In particular, the inner lobe spacer 12 includes a first face 54 (FIG. 8) having an inner lobe spacer recess 56 that is configured to receive the bearing spacer 34 when the inner lobe spacer 12 is connected from the device 10. Moreover, the inner lobe spacer recess 56 has a cylindrical shape with a diameter sized to clearance-fittingly receive the bearing spacer 34. Such a construction between the inner lobe spacer 12 and the bearing spacer 34 firmly connects the two components and inhibits the inner lobe spacer 12 and outer lobe 16 from wobbling as they rotate relative to the tether 20. As shown in the figures, the bearing spacer 34 partially extends out of the inner lobe spacer recess 56; in other embodiments, the height of the bearing spacer 34 and the inner lobe spacer recess 56 may be different so that the bearing spacer 34 is completely disposed within the spacer recess 56.

The first face 54 of the inner lobe spacer 12 further includes an annular recess 58 that houses a response or braking mechanism, such as a high-friction annular pad 60. Regardless of the specific type that is used, the response mechanism is engageable with the tether 20 to cause the tether 20 to wind around the bearing member 14 (e.g., to return the yo-yo 10 from a sleeper).

Adjacent the first face 54, the inner lobe spacer 12 further includes an angled surface 62 that faces a direction that forms an acute angle with the axle 18. As viewed from the side (or a section view as shown in FIG. 8), the outer angled surface 62 may have a flat diagonal shape or a curved shape. In either case, the angled surface 62, like the curved surface 42 of the outer lobe 16, ensures the tether 20 remains disposed between the inner lobe spacers 12 in use and inhibits the tether from engaging and winding around the inner lobe spacers 12.

In order to act as an extension of the outer lobe 16, the angled surface 62 preferably has a maximum diameter (and, as such, the inner lobe spacer 12 preferably has a maximum diameter) that is at least one half of the maximum diameter of the outer lobe 16. Such a diameter provides the inner lobe spacer 12 with a relatively high moment of inertia. As such, the moment of inertia of the entire yo-yo 10 changes significantly when the inner lobe spacers 12 are removed from the yo-yo 10, which thereby alters the "feel" of the yo-yo 10 in use.

Adjacent the angled surface 62 and opposite the first face 54, the inner lobe spacer 12 includes a second face 64 (FIG. 8) proximate the outer lobe 16. The second face 64 includes a rear recess 66 that partially receives the outer lobe 16 (see FIG. 5). This construction permits the angled surface 62 to intersect the curved surface 42 of the outer lobe 16, which in turn provides the appearance that the inner lobe spacer 12 and the outer lobe 16 form a single continuous component.

The second face 64 also includes a cylindrical projection 68 that extends through the rear recess 66. The projection 68 has a diameter sized such that it is clearance-fittingly received in the recess 44 of the outer lobe 16. Stated another way, the cylindrical projection 68 and the inner lobe spacer recess 56 have diameters that are equal within a clearance fitting range. This construction permits the outer lobe 16 to firmly connect to the inner lobe spacer 12 when the spacer 12 is connected to the device 10. Conversely, the outer lobe 16 is also capable of firmly connecting to the bearing spacer 34 when the inner lobe spacer 12 is removed from the device 10.

To permit the axle 18 to extend therethrough, the inner lobe spacer 12 includes an inner passageway 70 extending from the inner lobe spacer recess 56 through the projection 68.

The overall width of the inner lobe spacer 12 between the first face 54 and the second face 64 is preferably sufficiently large to significantly change the width of the yo-yo 10 when connected. In particular, the overall width of the inner lobe spacer 12 is preferably at least one third of the overall width of the outer lobe 16. Such a construction significantly affects the play characteristics of the yo-yo 10 when the inner lobe spacers 12 are connected to the yo-yo 10. As such, the yo-yo 10 noticeably acts as a string trick yo-yo when the inner lobe spacers 12 are used.

Steps for connecting the inner lobe spacers 12 to the yo-yo 10 and thereby widening the yo-yo 10 are generally as follows. Beginning with the yo-yo 10 in the configuration shown in FIGS. 1 and 2, one of the outer lobes 16 is held and the other outer lobe 16 is rotated to detach the outer lobes 16 and disconnect the nut 22 from the bolt 24*a*. Next, the bolt 24*a* is separated from the other components. The longer bolt 24*b* is then connected to one of the outer lobes 16, and the inner lobe spacers 12, the bearing spacers 34 and the bearing 26 are then positioned appropriately along the bolt 24*b*. Finally, the other outer lobe 16 and the nut 22 are rotated to attach the outer lobes 16 and connect the nut 22 to the bolt 24*b*. The above steps may be carried out in the opposite order to remove the inner lobe spacers 12 and decrease the width of the yo-yo 10.

Figure 10:
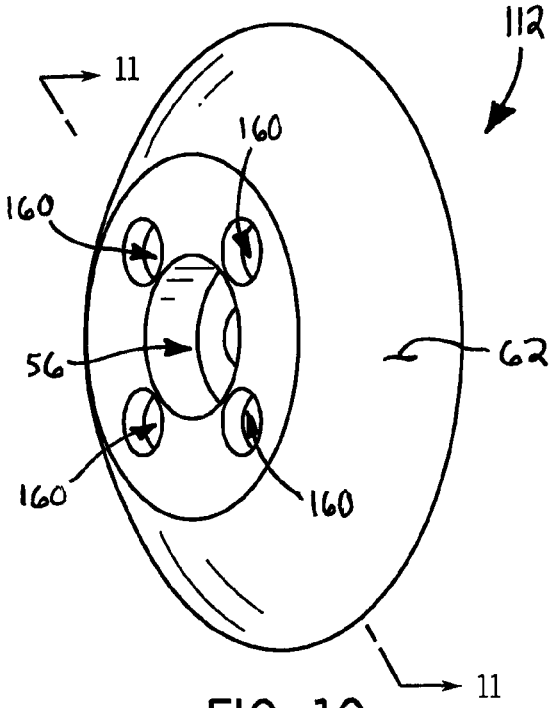
FIG. 10 is a perspective view of a second embodiment of an inner lobe spacer of the present invention.
Figure 11:
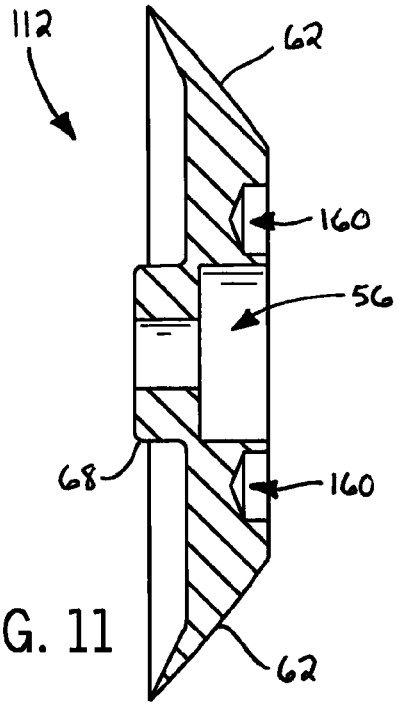
FIG. 11 is a section view of the inner lobe spacer along line 11-11 of FIG. 10.

The components of the yo-yo 10 may alternatively take other forms not explicitly described above. For example and referring now to FIGS. 10 and 11, a second embodiment of the inner lobe spacer 112 is generally as described above. However, the response mechanism, instead of including a relatively high friction material, includes a plurality of blind holes 160 spaced around the inner lobe spacer recess 56. In use, the tether is engageable against the edges of the blind holes 160 to cause the tether to wind around the bearing member (e.g., to return the yo-yo from a sleeper). As another example, the inner lobe spacer recesses 56, the projections 68, and the features they engage may have shapes other than cylindrical or round shapes.

From the above disclosure, it should be apparent that the present invention advantageously provides a rotatable performance device with modifiable play characteristics. As such, the device can act as both a relatively narrow looping device and a relatively wide string trick device. The invention also provides inner lobe spacers that facilitate these modifications and a method for modifying the rotatable performance device to change its play characteristics.

A preferred embodiment of the invention has been described in considerable detail. Many modifications and variations to the preferred embodiment described will be apparent to a person of ordinary skill in the art. Therefore, the invention should not be limited to the embodiment described.

I claim:

1. A spacer for increasing a width of a rotatable performance device supported by a tether, the rotatable performance device being operable with and without the spacer, and including an axle, a bearing member, a first outer lobe, and second outer lobe each supported by the axle, the first outer lobe and the second outer lobe each having an outer lobe recess, the spacer comprising:

a first face including a recess having a first cross-sectional size, the recess being configured to receive the bearing member;

a second face opposite the first face and including a projection having a second cross-sectional size, the second cross-sectional size being equal to the first cross-sectional size within a clearance fitting range, and the projection being configured to be removably received in the outer lobe recess of the first outer lobe; and an angled surface disposed between the first face and the second face, the angled surface facing a direction that forms an acute angle with a width direction between the first face and the second face, the angled surface thereby being configured to direct the tether away from the second face, wherein the spacer is configured such that when the spacer is installed the rotatable performance device defines a first longitudinal axial length, and when the spacer is removed the rotable performance device defines a second longitudinal axial length shorter than the first longitudinal axial length.

2. The spacer of claim 1, further comprising a through hole extending from the recess and through the projection and thereby being configured to permit the axle to extend therethrough.

3. The spacer of claim 1, wherein the projection has a first friction coefficient, the first face further includes a response mechanism having a second friction coefficient, and the second friction coefficient is greater than the first friction coefficient.

4. The spacer of claim 1, wherein the first cross-sectional size is a circular shape having a first diameter, the second cross-sectional size is an annular shape having a second diameter, and the second diameter is equal to the first diameter within the clearance fitting range.

5. A rotatable performance device for performing maneuvers as at least a portion of the device rotates relative to a tether engaging the device, comprising:

an axle;

a bearing member supported by the axle;

a first inner lobe spacer detachably supported by the axle and having a first inner lobe spacer recess sized to clearance-fittingly receive the bearing member;

a first outer lobe supported by the axle proximate the first inner lobe spacer and opposite the bearing member, the first outer lobe having a first outer lobe recess sized to clearance-fittingly receive the bearing member if the first inner lobe spacer is detached from the axle; and a second outer lobe supported by the axle opposite the first outer lobe, wherein the rotatable performance device is operable with and without the first inner lobe spacer, wherein when the first inner lobe spacer is installed the rotatable performance device defines a first longitudinal axial length, and when the spacer is removed the rotable performance device defines a second longitudinal axial length shorter than the first longitudinal axial length.

6. The rotatable performance device of claim 5, wherein the bearing member has a cylindrical shape, the first inner lobe spacer recess has a cylindrical shape, and the first outer lobe recess has a cylindrical shape.

7. The rotatable performance device of claim 5, wherein the first inner lobe spacer has a first inner lobe spacer projection opposite the first inner lobe spacer recess, and the first inner lobe spacer projection is sized to be clearance-fittingly received in the first outer lobe recess.

8. The rotatable performance device of claim 7, wherein the first inner lobe spacer projection has a cylindrical shape, and the first outer lobe recess has a cylindrical shape.

9. The rotatable performance device of claim 5, wherein the bearing member is a first bearing spacer, further comprising a tether bearing supported by the axle proximate the first bearing spacer and opposite the first inner lobe spacer, and the tether bearing being configured to engage the tether.

10. The rotatable performance device of claim 9, wherein the tether bearing includes an inner race engaging the first bearing spacer and an outer race rotatably supported by the inner race and configured to engage the tether.

11. The rotatable performance device of claim 9, further comprising:

a second bearing spacer supported by the axle proximate the tether bearing and opposite the first bearing spacer;

a second inner lobe spacer detachably supported by the axle and having a second inner lobe spacer recess sized to clearance-fittingly receive the second bearing spacer; and wherein the second outer lobe is supported by the axle proximate the second inner lobe spacer and opposite the second bearing spacer, and the second outer lobe has a second outer lobe recess sized to clearance-fittingly receive the second bearing spacer if the second inner lobe spacer is detached from the axle.

12. The rotatable performance device of claim 5, wherein the first inner lobe spacer has an angled surface disposed apart from the first inner lobe spacer recess, and the angled surface faces a direction forming an acute angle with the axle.

13. The rotatable performance device of claim 5, wherein the first outer lobe has a first overall width and the first inner lobe spacer has a second overall width, and the second overall width is at least one third of the first overall width.

14. The rotatable performance device of claim 5, wherein the first outer lobe has a first maximum diameter and an angled surface of the first inner lobe spacer has a second maximum diameter, and the second maximum diameter is at least one half of the first maximum diameter.

15. The rotatable performance device of claim 5, wherein the first inner lobe spacer has a first face facing away from the first outer lobe, the first face including the first inner lobe spacer recess and further including a response mechanism configured to engage the tether.

16. The rotatable performance device of claim 15, wherein the first inner lobe spacer recess is defined by a first inner lobe spacer wall having a first friction coefficient, the response mechanism includes a friction pad having a second friction coefficient, and the second friction coefficient is greater than the first friction coefficient.

17. The rotatable performance device of claim 15, wherein the response mechanism includes a plurality of blind holes defined by the first face.

18. A method of modifying a rotatable performance device for performing maneuvers as at least a portion of the device rotates relative to a tether engaging the device, the rotatable performance device including a first axle having a first longitudinal length, a first outer lobe supported by the first axle, and a second outer lobe supported by the first axle at a first distance from the first outer lobe, the method comprising the steps of:

detaching the first outer lobe and the second outer lobe from the first axle;

connecting a first inner lobe spacer to a second axle having a second longitudinal length, the second longitudinal length being greater than the first longitudinal length; and connecting the first outer lobe and the second outer lobe to the second axle such that the first inner lobe spacer is disposed between the first outer lobe and the second outer lobe and the first outer lobe is supported by the second axle at a second distance from the second outer lobe, the second distance being greater than the first distance.

19. The method of claim 18, wherein the rotatable performance device further includes a bearing member, and further comprising the steps of:

detaching the bearing member from the first axle; and positioning the bearing member within a recess of the first inner lobe spacer before connecting the first outer lobe and the second outer lobe to the second axle.

20. The method of claim 19, further comprising the step of removing the bearing member from a recess of the first outer lobe.

21. The method of claim 19, further comprising the step of connecting a second inner lobe spacer to the second axle between the first outer lobe and the second outer lobe such that the bearing member is positioned between the first inner lobe spacer and the second inner lobe spacer.

22. A kit for modifying a rotatable performance device for performing maneuvers as at least a portion of the device rotates relative to a tether engaging the device, the rotatable performance device including a first axle a bearing member, a first outer lobe supported by the first axle, and a second outer lobe supported by the first axle apart from the first outer lobe the first outer lobe and the second outer lobe each having an outer lobe recess, the kit comprising:

an inner lobe spacer configured to be disposed between the first outer lobe and the second outer lobe, the spacer including:

a first face including a recess having a first cross-sectional size, the recess being configured to receive the bearing member;

a second face opposite the first face and including a projection having a second cross-sectional size, the second cross-sectional size being equal to the first cross-sectional size within a clearance fitting range, and the projection being configured to be removably received in the outer lobe recess of the first outer lobe;

an inner passageway connecting the first face and the second face;

an angled surface disposed between the first face and the second face, the angled surface facing a direction that forms an acute angle with a width direction between the first face and the second face, the angled surface thereby being configured to direct the tether away from the second face; and a second axle defining a length longer than the first axle and configured to extend through the inner passageway and replace the first axle by engaging the first outer lobe and the second outer lobe, wherein the inner lobe spacer is configured such that when the inner lobe spacer and the second axle are installed the rotatable performance device defines a first longitudinal axial length, and when the inner lobe spacer is removed and the first axle is installed the rotatable performance device defines a second longitudinal axial length shorter than the first longitudinal axial length.

23. The kit of claim 22, wherein the second axle comprises a threaded bolt and a nut connected to the threaded bolt.

* * * * *